United States Patent [19]

Kinderman et al.

[11] Patent Number: 4,789,571

[45] Date of Patent: Dec. 6, 1988

[54] DECORATIVE GARLAND

[75] Inventors: Abraham S. Kinderman, Gladwyne, Pa.; Fred Maas, Bedford, N.Y.

[73] Assignee: J. Kinderman & Sons, Philadelphia, Pa.

[21] Appl. No.: 97,236

[22] Filed: Sep. 16, 1987

[51] Int. Cl.[4] ..... A41G 1/04

[52] U.S. Cl. ..... 428/10; 57/24; 57/203; 156/148; 493/958

[58] Field of Search ..... 428/10; 57/24, 203, 57/285; 156/148; 493/958

[56] References Cited

U.S. PATENT DOCUMENTS

| | | | |
|---|---|---|---|
| 3,215,047 | 11/1965 | Braun | 428/10 X |
| 3,223,454 | 12/1965 | Dieffenbach | 428/20 X |
| 3,637,452 | 1/1972 | Sanders | 428/10 X |
| 3,846,212 | 11/1974 | Rodermund et al. | 428/10 X |

*Primary Examiner*—Henry F. Epstein

*Attorney, Agent, or Firm*—Panitch Schwarze Jacobs & Nadel

[57] ABSTRACT

The present invention is directed to a garland comprising a core portion and a decorative portion surrounding the core portions, the decorative portion including a first component comprising a non-fibrous material and a second component comprising a fibrous material, the first and second components being intertwined around the core. The present invention is also directed to a method of making a garland comprising the steps of providing an elongated core, cutting a strip of non-fibrous material to produce a plurality of lateral fringes extending from a central longitudinal area of the strip, cutting a strip of fibrous material to produce a plurality of lateral fringes extending from a central longitudinal area of the strip, and winding the cut strips of fibrous and non-fibrous materials around the core to intertwine the fibrous and non-fibrous.

24 Claims, 1 Drawing Sheet

FIG. 1
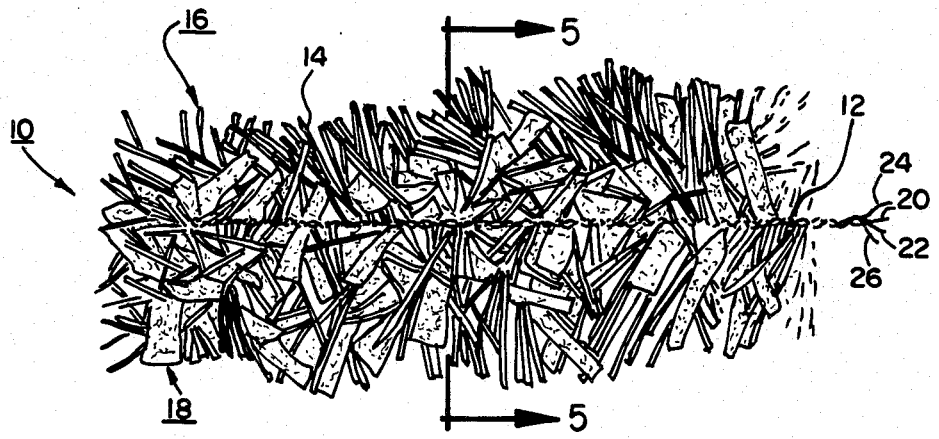
FIG. 2
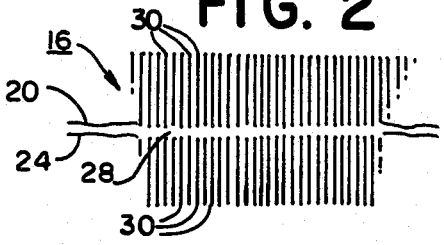
FIG. 3
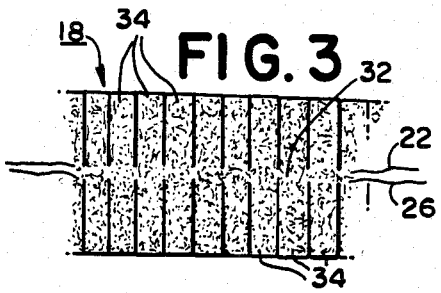
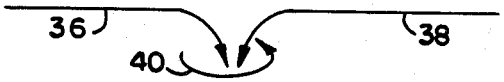
FIG. 4
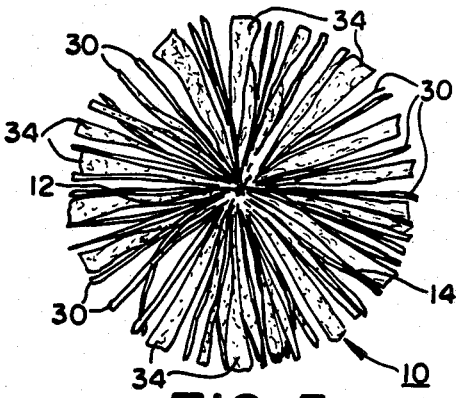
FIG. 5

DECORATIVE GARLAND

BACKGROUND OF THE INVENTION

The present invention relates to a decorative garland. More particularly, the present invention relates to a decorative garland of the type used to decorate Christmas trees and which is often suspended from ceilings, attached to walls and used as decorations in connection with other objects and structures. Such garlands typically are made from a thermoplastic material, such as polyvinyl chloride cut in strips where the strips are cut laterally to create fringes. The cut strips are then wound spirally around a core, such as wire, so that the fringes extend radially all around the wire to produce a pleasing, decorative effect. Typically, the garland is made out of a material with a metallic appearance.

The garland of the present invention includes a fibrous material in addition to a non-fibrous, thermoplastic material so that the garland has fringes of different textures and shapes, providing a very decorative effect. Preferably, the fibrous material used in the garland of the present invention is white. The white, fibrous material has a fluffy appearance which simulates snow, especially when it is intertwined among the fringes of the non-fibrous material. The garlands of the present invention are very popular for use as decorations during the winter and make ideal Christmas ornamentation.

SUMMARY OF THE INVENTION

One aspect of the present invention is directed to a garland comprising a core portion and a decorative portion surrounding the core portion, the decorative portion including a first component comprising a non-fibrous material and a second component comprising a fibrous material, the first and second components being intertwined around the core.

Another aspect of the present invention is directed to a method of making a garland comprising the following steps:

(a) providing an elongated core;

(b) cutting a strip of non-fibrous material to produce a plurality of lateral fringes extending from a central longitudinal area of the strip;

(c) cutting a strip of fibrous material to produce a plurality of lateral fringes extending from a central longitudinal area of the strip; and (d) winding the cut strips of fibrous and non-fibrous materials around the core to intertwine the fibrous and non-fibrous fringes.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 1 is a side elevational view of a garland according to the present invention in which the central core appears prominently for purposes of clarity.

FIG. 2 is a top plan view of a portion of a cut strip of non-fibrous material with core elements used to make the present invention.

FIG. 3 is a top plan view of a portion of a cut strip of fibrous material including core elements used to make the present invention.

FIG. 4 is a schematic diagram represented by arrows diagrammatically representing a method of making the garland of the present invention.

FIG. 5 is a vertical sectional view of a garland according to the present invention taken along lines 5—5 of FIG. 1.

DETAILED DESCRIPTION OF THE PREFERRED EMBODIMENTS

Referring to the drawings in detail, wherein like numerals indicate like elements throughout the several Figures, there is shown in FIGS. 1 and 5 a garland 10 according to the present invention. The garland 10 includes an elongated core portion 12 around which is formed a decorative portion 14. The decorative portion 14 comprises two different types of components, a first component 16 of non-fibrous material and a second component 18 of fibrous material. Each component 16 and 18 of the decorative portion 14 includes a plurality of fringes 30 and 34 extending generally radially from the core 12. As illustrated best in FIGS. 1 and 5, the fringes 30 of non-fibrous material 16 have a different shape and texture than the fringes of the fibrous material 18. Due to the intertwining of the fringes of the different materials, the fringes have a somewhat random arrangement, yet provide a pleasing, decorative appearance.

The core portion 12 may include any suitable elongated support member, such as a single wire, cord, string or the like. It is preferred that the core comprise at least one wire and one thread and most preferably, as illustrated two wires 20 and 22 and two threads 24 and 26. The wires 20 and 22 provide the primary support for the decorative portion 14 while the threads 24 and 2 provide good retention and attachment of the decorative portion to the wires 20 and 22. Use of the threads is particularly helpful in securing the fibrous component 18 to the wires. The textile thread helps keep the fibrous component 18 from slipping along the wires. As the garland is formed, the wires and threads are twisted, preferably simultaneously with the winding of the components 16 and 18 of the decorative portion 14 around the core 12.

In the presently preferred embodiment, each wire 20 and 22 comprises two strands of 30 gauge zinc wire. Also in the presently preferred embodiment, each thread 24 and 26 comprises two strands of 20/2 polyester thread.

With reference to FIG. 2, the non-fibrous component 16 may be made from any number of materials, but preferably is made from a synthetic thermoplastic polymer, and most preferably is made from polyvinyl chloride. A pleasing effect is created when the non-fibrous material 16 has a metallic appearance which may be created by techniques well known to those skilled in the art and used with conventional garlands. The presently preferred techniques are to metallize and lacquer the polyvinyl chloride forming the non-fibrous material 16. Preferred colors for the non-fibrous material are gold, silver, metallic green and metallic red, though, of course, the non-fibrous material may be of other colors or even transparent.

The non-fibrous material 16 generally comes in rolled sheets which are slit into strip rolls of convenient widths, such as the presently preferred width of about 2½ inches. The strip roll of the non-fibrous material is then mounted on a typical tub garland machine well known to those skilled in the art but which has been modified as set forth hereinafter to produce the present invention.

The non-fibrous material 16 passes between a rotary cutter having a plurality of transverse blades and an anvil having a groove formed in its center. When the strip of non-fibrous material passes through this cutting assembly, the strip is cut to the form illustrated in FIG. 2. The cut srrip includes a central longitudinal area 28 having a width corresponding to the width of the groove in the anvil. A plurality of fringes 30 extends generally laterally from both sides of the central longitudinal area 28. Also illustrated in FIG. 2 are wire 20 and thread 24 which are not connected to the cut strip of non-fibrous material 16 at this stage in the manufacture, but which may extend below and be oriented with the cut strip.

The width of the central longitudinal area 28 should be sufficient to maintain the structural integrity of the cut strip of the non-fibrous material 16 as it is wound around the core 12. Accordingly, the width of the central longitudinal area 28 will depend on several factors, including the type of non-fibrous material used, the thickness of the material, the strength characteristics of the material, etc. It is presently preferred that the central longitudinal area 28 have a width of about 1/32 inch where the non-fibrous material is metallized and lacquered polyvinyl chloride having a presently preferred thickness of about 3 mils.

The presently preferred width of the fringes 30 is about 375 mils. In the preferred embodiment of the modified tub garland machine adapted to make the garland of the present invention, the cutting roller for making the cut strip of non-fibrous material 16 has 84 cutting blades on a cutting wheel having a diameter of about 4.25 inches which rotates at about 250 RPM.

FIG. 3 illustrates a cut strip of fibrous material 18 having a central longitudinal area 32 from which a plurality of fringes 34 extend generally laterally. In a manner similar to that described with respect to FIG. 2, the wire 22 and thread 26 are shown in FIG. 3 as unconnected with the cut strip of fibrous material 18 but generally aligned with the cut strip in the vicinity of the central longitudinal area 32.

The fibrous material 18 may be made of any of several synthetic or natural fibers formed into a web in a manner to have sufficient strength to withstand the preferred mechanical process by which it is used to make the garland of the present invention, to be durable when the garland is in use and provide sufficient bulk to create the desired visual effect, preferably simulating snow. The presently preferred material is formed from a web of 100% polyester of 2.25 denier made of two inch staples. The fiber is carded on a Garnett carder machine and sprayed with an ethylene vinyl chloride resin including a flame retardant comprising an aqueous dispersion of antimony trioxide and decabromodiphenyl ether. The ethylene vinyl chloride and flame retardant are applied in an amount of about 20% by weight of the combined fiber web and resin/retardant mixture. After the web is dried, it is run over a hot roll at a temperature of about 340 degrees Fahrenheit to about 380 degrees Fahrenheit to have one smooth side which provides enhanced stability. The presently preferred polyester fiber web has a thickness of about 150 mils plus or minus 10% upon completion of its manufacture and weighs about 1.8 ounce per square yard, plus or minus 7%.

The polyester fiber web is then placed onto rolls which are slit and formed into strips about 2½ inches wide. The thickness of the polyester strip after being unwound from the rolls ready for use in the method of the present invention most preferably is about 100 mils.

A roll of the slit fibrous material 18 is placed on the modified tub garland machine and run between a hardened rotary cutter having transverse cutting blades and an anvil having a central groove formed in it. The strip of the fibrous material 18 is thereby cut as illustrated in FIG. 3 to produce a plurality of lateral fringes 34 extending from both sides of the central longitudinal area 32. In the presently preferred embodiment, the central longitudinal area 32 has a width of about 3/32 inch which corresponds to the width of a groove formed in the anvil associated with the rotary cutter. The preferred rotary cutter has 20 cutting blades mounted on a cutting wheel about 4.25 inches in diameter rotating at a presently preferred speed of about 150 RPM. By making the proper adjustments, the preferred cut strip of fibrous material 18 is cut to produce the fringes 34 having a width of about ¼ inch or 250 mils.

FIG. 4 illustrates in a very diagrammatic manner the method by which the garland is formed on the tub garland machine from the cut strip of non-fibrous material 16, wire 20 and thread 24 from FIG. 2, represented by the directional arrow 36, and the cut strip of fibrous material 18, wire 22 and thread 26 of FIG. 3, represented by directional arrow 38. Thus, when the rolls of the uncut strip materials 16 and 18 are mounted on the tub garland machine, the strips travel toward each other and toward the center of the machine, each passing through a respective cutting roller and anvil assembly.

The cut strips 16 and 18 and associated wires and strings travel toward each other and through a pair of closely aligned stuffer rollers on the tub garland machine. In the presently preferred embodiment, the stuffer rollers are about two inches in diameter with the stuffer roller primarily associated with the cut strip of fibrous material 18 having a rubber coating. The stuffer rollers rotate at a presently preferred speed of about 124 RPM.

The stuffer rollers feed the cut strip 16 and 18, the wire 20 and 22 and the threads 24 and 26 into a rotating tube aligned with and located below the stuffer rollers. The rotating tube is axially and concentrically located within a rotating tub forming a part of the tub garland machine. In the presently preferred embodiment, the tube has a diameter of about 4 inches and the tube and tub rotate at a speed of about 730 RPM.

By this operation, the wires and threads are twisted together to form the core 12 and the cut strips 16 and 18 are wound spirally around the core in such a manner that the fringes 30 and 34 are intertwined and extend generally radially from the core as illustrated in FIG. 5. The winding operation is diagrammatically indicated by arrow 40 in FIG. 4. The winding takes place simultaneously with the upstream cutting of the strips of material 16 and 18 to form the fringes 30 and 34 respectively.

In the presently preferred method of making the garland, the garland exits the open bottom of the tube where is it formed and accumulates in the spinning tub at a rate of about 23 feet per minute.

Although a garland according to the present invention could be made rather crudely by hand, it is preferred to use a tub garland machine modified as set forth above so that the garland of the present invention can be made economically and efficiently.

The resulting garland as best illustrated in FIGS. 1 and 5 has a good, fairly random distribution of non-fibrous fringes 30 and fibrous fringes 34. The combination of the different textures, thicknesses and widths of the fringes, as well as the preferred contrasting color in which the fibrous material 18 is white, simulating snow, to create the unique decorative garland of the present invention. To create this effect, it is preferred that the fringes 34 of the fibrous component 18 are considerably wider than the fringes 30 of the non-fibrous component 16, on the order of about five to about ten times as wide. Similarly, to produce the desired effect, the fringes 34 of the fibrous component 18 should be thicker than the fringes 30 of the non-fibrous component 16.

The present invention may be embodied in other specific forms without departing from the spirit or essential attributes thereof, and, accordingly, reference should be made to the appended claims, rather than to the foregoing specification as indicating the scope of the invention.

We claim:

1. A garland comprising an elongated core portion and a decorative portion surrounding the core portion, the decorative portion including a first component comprising a non-fibrous material and a second component comprising a fibrous material, both the first and second components being intertwined around and along substantially the entire length of the core.

2. A garland according to claim 1 wherein the first and second components each comprises a strip of material having a central longitudinal area and a plurality of fringes extending laterally from the central longitudinal area and generally radially around the core portion.

3. A garland according to claim 2 wherein the fringes of the second fibrous component are wider than the fringes of the first non-fibrous component.

4. A garland according to claim 3 wherein the fringes of the second fibrous component are about five to about ten times as wide as the fringes of the first non-fibrous component.

5. A garland according to claim 2 wherein the fibrous material is thicker than the non-fibrous material.

6. A garland according to claim 1 wherein the fibrous material comprises a web of polyester fibers.

7. A garland according to claim 1 wherein the non-fibrous material comprises polyvinyl chloride.

8. A garland according to claim 1 wherein the second fibrous component is white and the first non-fibrous component is a color other than white.

9. A garland according to claim 8 wherein the first non-fibrous component has a metallic appearance.

10. A garland according to claim 1 wherein the core portion includes at least one wire.

11. A garland according to claim 10 wherein the core portion includes at least one thread.

12. A garland according to claim 11 wherein the core includes two wires and two threads.

13. A method of making a garland comprising the following steps:

(a) providing an elongated core;

(b) cutting a strip of non-fibrous material to produce a plurality of lateral fringes extending from a central longitudinal area of the strip;

(c) cutting a strip of fibrous material to produce a plurality of lateral fringes extending from a central longitudinal area of the strip; and (d) simultaneously winding both the cut strips of fibrous and non-fibrous materials around the core to intertwine the fibrous and non-fibrous fringes.

14. A method according to claim 13 wherein steps (b) and (c) are performed simultaneously with each other.

15. A method according to claim 13 wherein the cut strips are wound around the core within a tube rotating at a rate of about 730 RPM.

16. A method according to claim 13 wherein the fibrous material is cut between a rotary cutter and an anvil, the rotary cutter having a diameter of about 4.25 inches with 20 equally spaced transverse cutting blades and rotating at about 150 RPM.

17. A method according to claim 13 wherein the non-fibrous material is out between a rotary cutter and an anvil, the rotary cutter heaving a diameter of about 4.25 inches with 84 equally spaced transverse cutting blades and rotating at about 250 RPM.

18. A method according to claim 13 wherein the cut strips of fibrous and non-fibrous material are wound around the core to produce a garland at a production rate of about 23 feet per minute.

19. A method according to claim 13 wherein the core oomprises at least one wire and at least one thread.

20. A method according to claim 19 wherein the core comprises two wires and two threads.

21. A method according to claim 13 wherein the fringes of the cut strip of fibrous material are wider than the fringes of the cut strip of non-fibrous material.

22. A method according to claim 21 wherein the fringes of the cut strip of fibrous material are from about five to about ten times as wide as the fringes of the cut strip of non-fibrous material.

23. A method according to claim 13 wherein the fibrous material is thicker than the non-fibrous material.

24. A method according to claim 13 wherein the fibrous material comprises a web of polyester fibers.

* * * * *